United States Patent [19]

Nishioka

[11] 4,291,664

[45] Sep. 29, 1981

[54] PROJECTILE SHOOTING GUIDE FOR BOWS

[76] Inventor: Jim Z. Nishioka, 1268 Hemlock, N. W., Salem, Oreg. 97304

[21] Appl. No.: 34,287

[22] Filed: Apr. 30, 1979

[51] Int. Cl.[3] ..... F41B 5/00

[52] U.S. Cl. ..... 124/41 A; 124/87; 273/416; 273/423

[58] Field of Search ..... 124/24 R, 41 A, 88, 124/80, 22

[56] References Cited

U.S. PATENT DOCUMENTS

| | | | |
|---|---|---|---|
| 1,526,176 | 2/1925 | O'Connell | 124/24 R |
| 3,572,311 | 3/1971 | Baer | 124/41 A |
| 4,027,645 | 6/1977 | Damron | 124/24 R |
| 4,146,009 | 3/1979 | Adams | 124/24 R X |

FOREIGN PATENT DOCUMENTS

| | | | |
|---|---|---|---|
| 524405 | 5/1956 | Canada | 124/24 R |

*Primary Examiner*—Richard C. Pinkham
*Assistant Examiner*—William R. Browne
*Attorney, Agent, or Firm*—Eugene M. Eckelman

[57] ABSTRACT

An elongated guide member is mounted on a bow by a support and in its mounted position the guide member extends toward the bowstring. The guide member is slidable in the support and in turn slidably receives a projectile arranged to be propelled by the bowstring. The guide member and projectile structures allow the projectile to extend beyond the rearward end of the guide member to allow the bowstring to be disposed in a bowstring nock in the projectile in the common drawing movement of the bowstring, the guide member and the projectile. A closed portion of the guide member in one embodiment has releasable structure allowing the bowstring to be moved laterally into the guiding area. In another embodiment, guide member and projectile structures allow the projectile to extend through a side slot in the guide member for engagement with the bowstring outside the guide member. The projectile in this embodiment may be provided with off-center multiple nocks. Adjustment is provided for the guide member to vary its horizontal and vertical angulation. Adjustable sights are provided on the guide member to further increase the accuracy of shooting. The support of the apparatus on the bow allows the entire guide to be turned to a position adjacent to and along the bow frame in a compacted non-use position. Adjustable friction drag device may be employed between the guide member and the support to control the slidable freedom of the guide member.

11 Claims, 23 Drawing Figures

PROJECTILE SHOOTING GUIDE FOR BOWS

FIELD OF THE INVENTION

This invention relates to new and useful improvements in projectile shooting guides for bows.

SUMMARY OF THE INVENTION

According to the present invention and forming primary objectives thereof, a projectile shooting guide for bows is provided having a novel structural arrangement of a guide member and projectile. Adjustment means are also used to increase the accuracy of shooting of the projectile.

In carrying out the invention, an elongated guide member is mounted on support means attachable to a bow, and such guide member includes guide means therein for guiding a projectile to be shot by the bowstring. A structural combination is provided in one embodiment which allows the bowstring, the guide member, and the projectile to be moved rearwardly in unison in drawing movements of the bowstring, and furthermore the guide member has means for laterally threading the bowstring thereinto when a bowstring is to be changed on the bow. The structural combination of another embodiment employs a guide member and projectile which allow movement of the bowstring outside of and parallel with the guide member. The projectile in this embodiment extends through a slot in the guide member for engagement with the bowstring and has off-center multiple nocks. During drawing motions of the bow the bowstring is positioned rearward of the rear end of the guide member. Adjustment means are provided in association with the support means and the guide member to adjust alignment of said guide member relative to the bow for accurate shooting and adjustable friction drag means are employed between said guide member and its support to control the slidable freedom of said guide member. Adjustable sighting means are provided also to increase the accuracy of shooting. Another feature of the present invention is that the structure can be compacted close to the bow in a non-use position.

The invention will be better understood and additional objects and advantages will become apparent from the following description taken in connection with the accompanying drawings.

DETAILED DESCRIPTION OF PREFERRED EMBODIMENTS

Figure 2:
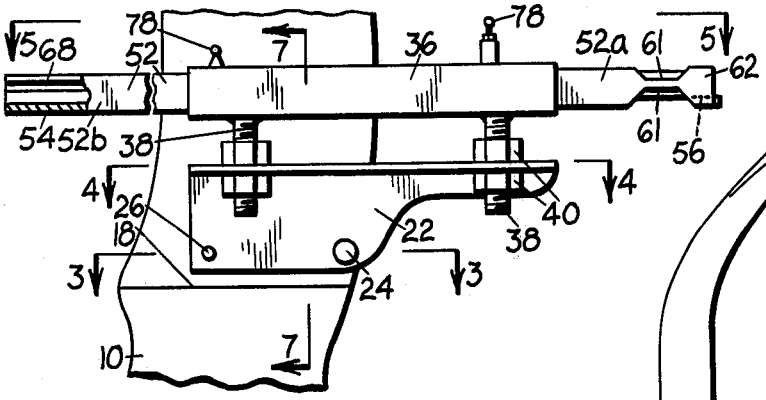
FIG.2 is a fragmentary enlarged side elevational view of the shooting guide taken similar to FIG. 1.
Figure 3:
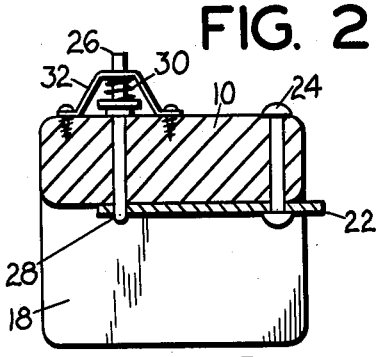
FIGS. 3 and 4 are horizontal sectional views taken on the lines 3—3 and 4—4 of FIG. 2, respectively.
Figure 1:
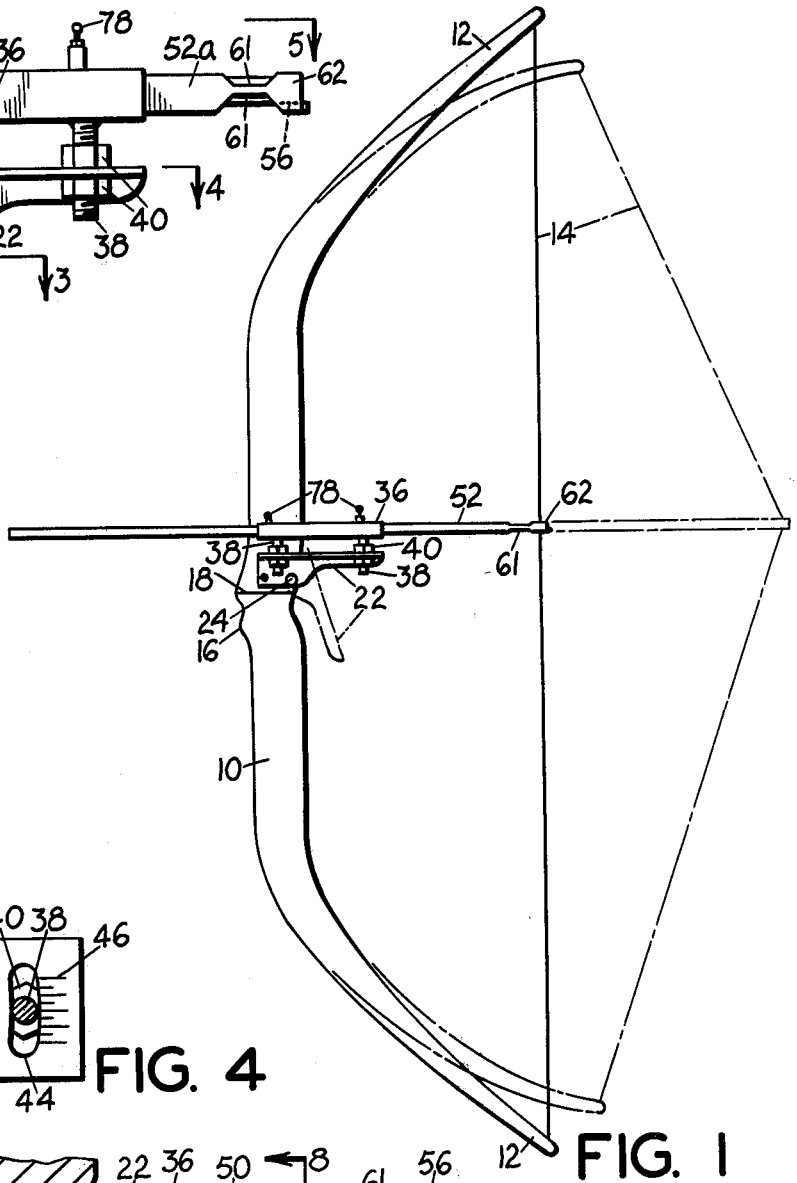
FIG. 1 is a side elevational view of a bow and a first form of shooting guide embodying principles of the present invention.
Figure 4:
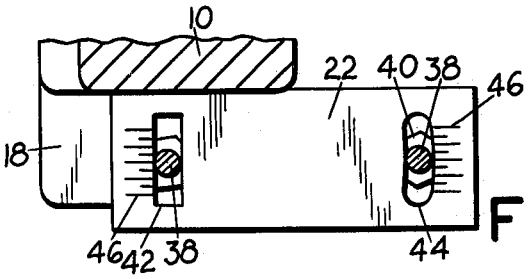
Figure 5:
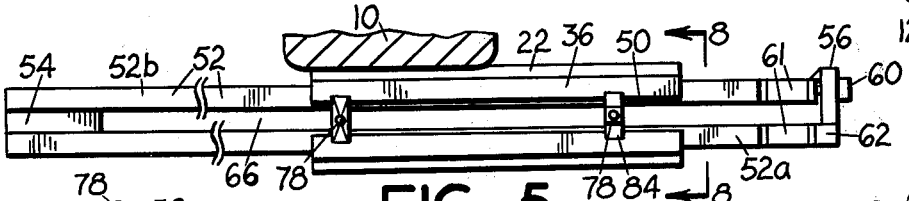
FIG. 5 is a top plan view of a guide member in the shooting guide.
Figure 6:
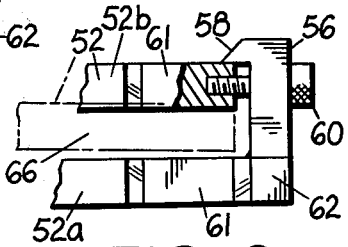
FIG. 6 is an enlarged fragmentary plan view showing details of a rear portion of the guide member.

With reference first to FIGS. 1 and 2, the present invention is arranged for use with a conventional archery bow having a frame portion 10 and bow limbs 12 or other tensioning means. A bowstring 14 is connected between the limbs, and the bow has the usual hand grip portion 16 and an arrow shelf 18.

A first form of guide is shown in FIGS. 1–8 and comprises a right angle support bracket 22 arranged to be secured to the frame 10 of the bow just above the arrow shelf 18. In a preferred construction, bracket 22 is secured to the bow frame 10 so as to provide a use position substantially at right angles to the bow frame and a non-use compacted position adjacent to and substantially parallel with the bow frame. For this purpose, a two-point support is provided one of which comprises a pivot support pin 24, FIGS. 1–3, located closely adjacent one edge of the frame 10 and a releasable support pin 26 which projects into an aperture 28 in the bracket 22 and has spring pressed support by means of a spring 30 in a spring housing 32 on the other side of the bow, whereby upon releasing the pin 26 from aperture 28, the bracket 22 can be swung down to the dotted line position shown in FIG. 1 so as to compact the structure into a non-use condition.

Figure 7:
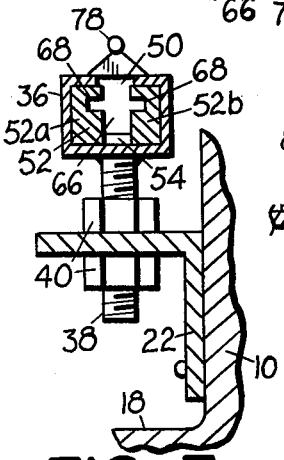
FIG. 7 is a vertical sectional view taken on the line 7—7 of FIG. 2.
Figure 8:
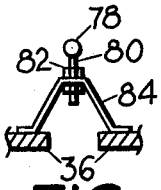
FIG. 8 is an enlarged fragmentary sectional view taken on the line 8—8 of FIG. 5.

A tubular housing or holder 36 which is rectangular in cross section is supported on the bracket 22, and the connecting support between such housing and the bracket comprises a pair of screws 38, FIGS. 1, 2 and 7, that depend integrally from housing 36 and have a double nut connection 40 with the bracket. In the connections 40, the forward screw 38 extends through a rectangular slot 42 in the bracket, FIG. 4, and the rearward screw extends through an arcuate slot 44 in such bracket, these two slots being elongated in a lateral direction relative to the diameters of the screws.

By means of the screw and double nut connection of the housing 36 on the bracket 22 and also by means of the elongated slots 42 and 44, the housing can be adjusted for elevation or horizontal angulation and furthermore it can be adjusted for windage or lateral angulation. Each of the slots 42 and 44 has calibrations 46 along one edge to assist in accomplishing the adjustment.

Housing 36 has a top longitudinal slot 50 open the full length thereof, and this housing comprises a support for a projectile guide member or barrel 52, such guide member also being rectangular in cross section and having free slidable movement in the housing. Guide member 52 comprises a pair of parallel rails **52*a* and 52*b* which are connected together integrally at the front by a bottom wall segment 54, best seen in FIGS. 2 and 5. These rails are also connected together at the rear but releasably by a lateral extension 56, FIGS. 5 and 6, on rail 52*a* which terminates in a forwardly turned finger 58 extending a short distance forward of the rearward end of rail 52*b*. A secured connection of the rail 52*b* to rail 52*a* is provided by a releasable hand screw 60 passing through the lateral extension 56 and threadedly engaged in a bore in the rearward end of the rail 52*b*. By means of this structure, the rails are held in a fixed spaced relationship but when desired a bowstring is arranged to be installed between the rails 52*a* and 52*b* forward of the lateral extension 56 simply by removing screw 60 and moving the bowstring between the rail 52*b* and the finger 58 while springing the element 52*b* inwardly a slight amount, such as to the broken line position shown in FIG. 6. After the bowstring has been installed, the screw 60 is reinserted which as is apparent the rails 52*a* and 52*b* are again held in secure spaced relation by the extension 56. The front wall segment 54** maintains the rails in uniform spacing at the front.

Lateral extension 56 comprises a relatively thin wall and as seen in FIG. 1, it is disposed in a lower position of the guide member for a purpose to be described. Also for a purpose to be described, the sides **52*a* and 52*b* have upper and lower notches 61 forming a knob 62 at the rearward end of the guide member 52**.

As best seen in FIG. 7, the guide member elements **52*a* and 52*b* form a guide slot 66 therebetween. This slot has side extensions 68 between the top and bottom thereof. Slot 66 extends the full length of the defining elements 52*a* and 52*b*** and opens through the front and rear thereof as well as through the top also the full length of the guide member.

Figure 9:
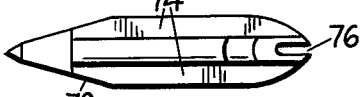
FIG. 9 is a top plan view of a projectile that may be used with the instant guide.
Figure 10:
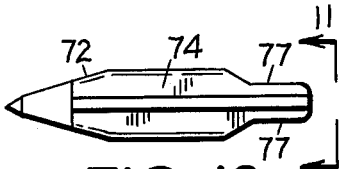
FIG. 10 is a side elevational view of the projectile.
Figure 11:
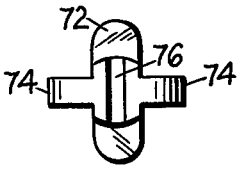
FIG. 11 is a rear elevational view of the projectile, taken on the line 11—11 of FIG. 10.
Figure 12:
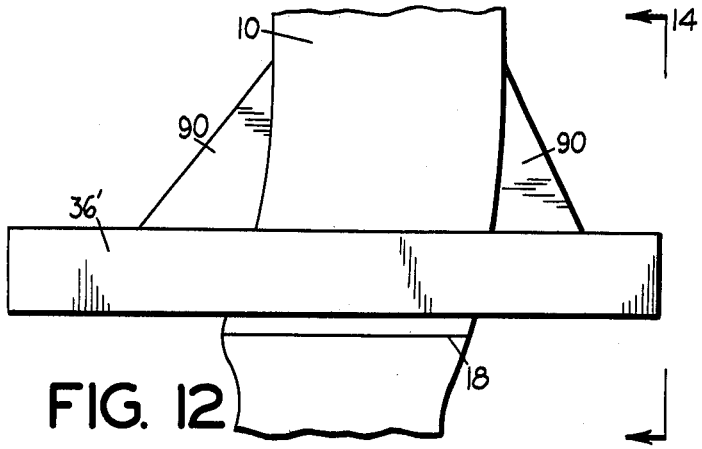
FIG. 12 is a side elevational view of a second form of shooting guide embodying principles of the present invention.
Figure 13:
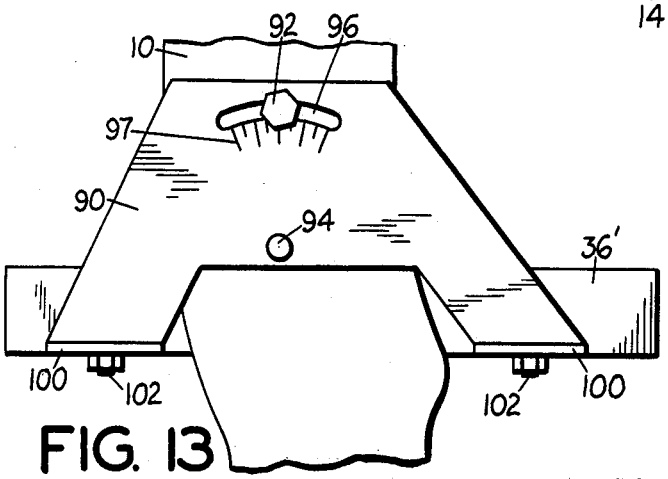
FIG. 13 is also a side elevational view of the embodiment of FIG. 12 but taken from the other side of the bow.
Figure 14:
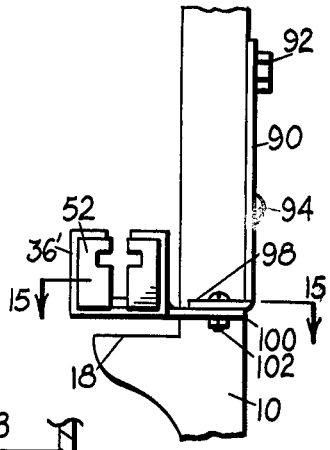
FIG. 14 is a rear elevational view taken on the line 14—14 of FIG. 12.

A projectile 72 for use with the shooting guide of FIG. 1 is shown in FIGS. 9, 10 and 11, such projectile having a body portion of selected vertical dimension to slide freely in the slot 66 and having side wings 74 engageable in the side slot extensions 68. The rearward end of the projectile has a vertical bowstring engaging notch 76 and upper and lower notches 77 forming a tail of reduced vertical dimension. The guide slot 66 and the projectile are dimensioned and arranged such that the projectile will clear the front wall segment 54, and also in view of the lower disposition of the lateral wall 56 and the notches 77 in the projectile, the rearward end of the projectile in a rearward position thereof can project a short distance beyond the rearward end of the guide member 52. With this arrangement the user can grasp the projectile as well as the knob 62 and bowstring in drawing movements of the latter.

Housing 36 is provided with front and rear sights 78. One or both of these sights is adjustable vertically, such being accomplished by providing the sights with a screw stem 80, FIG. 8, having a double nut connection 82 on a bracket 84 secured to the housing 36.

In the use of the present shooting guide, it is installed on the bow frame by means of the pins 24 and 26 and suitable elevation or horizontal angulation adjustment is accomplished by the vertical positioning of screws 38 and windage or lateral angulation adjustment is accomplished by lateral positioning of these same screws in slots 42 and 44. The guide member 52 is inserted into the housing 36 from the rearward end of the latter, and the bowstring is installed in such guide member by first removing screw 60 and springing the guide rail **52*b* toward the rail 52*a*. Upon installing the bowstring into the guide member past the rearward end of rail 52*b*, the screw 60 is reinstalled. The lateral installation of the bowstring into the guide member eliminates the necessity of installing the bowstring endwise through the guide member which obviously eliminates the necessity of restringing the bow. The projectile 72 is inserted from the front of the guide member 52 and the slot 76 of such projectile is brought into engagement with the bowstring. In drawing the bow, the archer grasps the bowstring and also lightly grasps the projectile between a pair of his fingers, the projectile being available for such gripping as a result of notches 61 as seen in FIG. 2. Upon drawing the bowstring, the bowstring engages the closed portion 56 of the guide member and such guide member and projectile thus move in unison with the bowstring. The knob 62 may assist the archer in drawing the bowstring if he desires to use it. Upon release of the bowstring, the projectile is propelled forwardly along the guide member and out the front, the guide member remaining stationary whereby the entire force of the bowstring acts on the projectile. Slidable movement of the guide member relative to the housing 36** allows such guide member to be readily removed when stored or carried or to be centered for maximum compactness during the time it is supported in the housing but not in use.

With reference to FIGS. 12–15, an alternative form of support is provided comprising a plate-like mounting bracket 90 secured upright to the bow frame 10 on the side opposite from the arrow shelf 18 by means of a screw 92 and a pivot pin 94. Screw 92 extends through an arcuate slot 96 in the plate 90 and is arranged to hold the upper portion of the bracket 90 firmly against the bow but when loosened it allows pivotal adjustment of the bracket on the pin 94. Calibrations 97 are provided adjacent the slot 96 for accuracy of adjustment.

Figure 15:
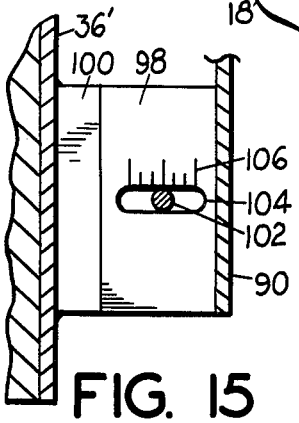
FIG. 15 is a fragmentary sectional view taken on the line 15—15 of FIG. 14.

The bottom of bracket 90 has a pair of right angle ears 98 arranged to extend one on each side of the bow frame 10, and these ears are secured to respective ears 100 projecting from a guide housing 36'. With reference to FIG. 15, ears 98 and 100 are connected by releasable screws 102 passing through suitable apertures in ears 98 and through laterally elongated slots 104 in the ears 100. Calibrations 106 are provided adjacent the slot 104 for accuracy of adjustment.

Guide housing 36' slidably receives a guide member 52 identical to the member 52 as described in connection with FIG. 1. The embodiment of FIGS. 12–15 accomplishes the same adjustment features as in FIG. 1 in that suitable elevation and windage adjustments can be accomplished by means of the support means 92 and 94 and attaching screws 102.

Figure 16:
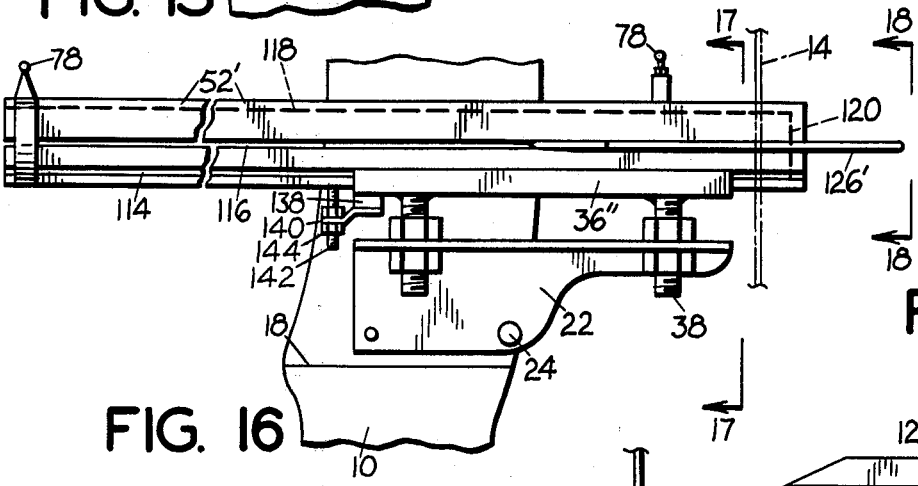
FIG. 16 is a fragmentary side elevational view of a further form of shooting guide embodying principles of the present invention.
Figure 17:
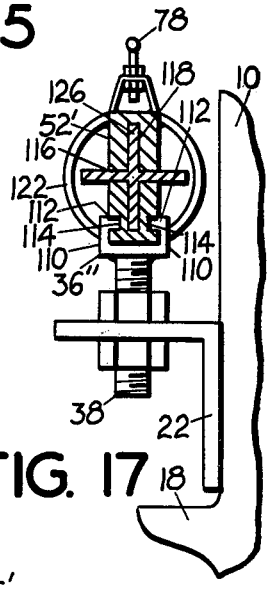
FIG. 17 is an enlarged vertical sectional view taken on the line 17—17 of FIG. 16.
Figure 18:
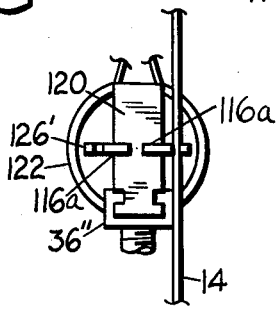
FIG. 18 is a fragmentary rear elevational view taken on the line 18—18 of FIG. 16.

With reference to FIGS. 16–18 another form of guide member is shown. In this form, the support bracket 22 is identical to the structure of FIG. 1, including adjustments for elevation and windage and also including the compacting feature.

In this form, the bracket 22 integrally supports a longitudinal holder 36″ having vertical walls 110 and inturned upper ends 112 terminating short of each other. The guide member 52′ of this embodiment has slidable connecting engagement with holder 36″ and for this purpose such guide member has side grooves 114 receiving the inturned ends 112 in a stable but slidable fit.

Guide member 52′ has a full width transverse slot 116, FIGS. 16 and 17. Such guide member also has an upright slot 118 terminating short of the upper and lower ends thereof, FIG. 17. Slots 116 and 118 open through the front of the guide member, the slot 118 terminating at a wall 120 at the rearward end of the guide member and the slot 116 having rear openings **116*a*, FIG. 18, through wall 120. The front end of the guide member has reinforcing and connecting webs 122**.

With reference to FIGS. 16 and 17, a rearward sight 78 is secured to the guide member 52′ and a forward sight 78 is secured to the reinforcing web 122 of the guide member 52′. The sights are thus slidable with the guide member during shooting motions and provide close positioning to the user's eyes in a drawn position of the bowstring for accurate aiming.

The embodiment of FIGS. 16–18 is employed with an outside association of the bowstring 14, namely, the bowstring operates exteriorly thereof at one side. For this purpose, a projectile 126 of the structure shown in FIGS. 19 and 20 may be used. This projectile has a thin vertical body portion 128 for guided movement in the slot 118 and thin side wings 130 for guided movement in the slot 116. The side wings 130 of this projectile have rearward tail extensions 132 and have a slot 134 therebetween which will allow the projectile to move rearwardly with the tail portions straddling the portion of wall 120 between slot openings **116*a* and projecting beyond the rearward end of guide member 52′, the rear edge of the projectile body portion engaging the inner side of wall 120 in its fully retracted position. Nocking notches 136 are provided in one or both of the tail extensions 132**.

In the operation of the embodiment of FIG. 16, the projectile is inserted from the front and moved rearwardly to a point such that the extensions 132 project rearwardly of the guide member for engagement by the bowstring, the guide member being moved rearwardly a selected amount relative to the support 36″ to accomplish engagement of one of the nocking means 136 with the bowstring. In shooting the projectile, the bowstring moves outside of and parallel with the guide member.

Figure 19:
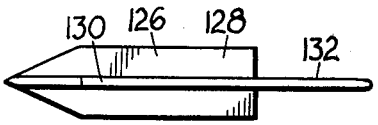
FIG. 19 is a side elevational view of a projectile that may be used with the embodiment of FIG. 16.
Figure 20:
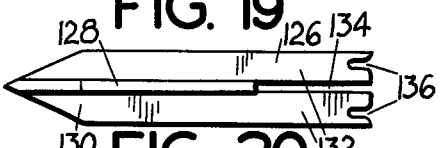
FIG. 20 is a top plan view of the projectile of FIG. 19.
Figure 21:
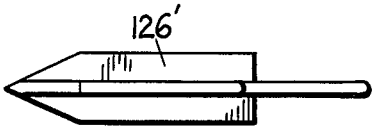
FIG. 21 is a side elevational view of another form of projectile that may be used with the embodiment of FIG. 16.
Figure 22:
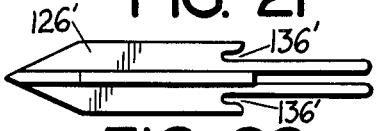
FIG. 22 is a top plan view of the projectile of FIG. 21.
Figure 23:
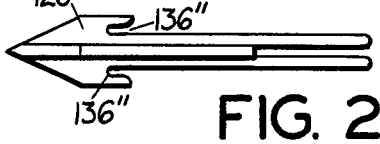
FIG. 23 is a top plan view of yet another projectile structure that may be used with the embodiment of FIG. 16.

FIGS. 21 and 22 show a similar projectile 126′ as in FIGS. 19 and 20 but illustrate the concept that the nocking means 136′ may be located forwardly almost to the middle of the projectile. FIG. 23 shows a projectile 126″ also of similar structure except that the nocking means 136″ is located substantially forward of the middle portion of the projectile.

The embodiment of FIG. 16 has the advantage that the wing portions of the projectile 126 used therewith may comprise a grip adjacent to the bowstring which the user can grip to draw the bow. Positioning the grip portion rearward of the rearward end of the guide member allows its vertical thickness to be less than the vertical thickness of the guide member, namely, more like the thickness of an arrow. This gives a more natural feel and reduces finger pinch caused by the bowstring squeezing the fingers during the drawing motion of the bow. The wing portions improve stability of the projectile in flight. Since the bowstring engages the projectile off the lateral center of the projectile, a wider projectile can be used without increasing the lateral clearance between the bowstring and the bow frame. A projectile 126′ is shown in place in FIG. 16 ready for a draw of the bowstring 14.

A drag structure may be provided to create a friction or drag for movements of the guide member 52′, FIG. 16, in the holder 36″. This drag structure includes a base 138 integral with the holder and a spring arm 140 in turn integral with the base. This spring arm extends beyond the base in overlapping association with the guide member 52′ and supports a threaded pin 142 adjustably mounted thereon by double lock nuts 144. The inner end of the pin 142, urged by the spring action of the arm 140, frictionally engages the guide member 52′. The spring arm provides the spring means or resiliency for a smooth drag as the guide member is moved. The inner end of the shaft may be capped with plastic if desired or it may support a roller bearing. To adjust the drag structure, the shaft is merely adjustably rotated in the desired direction to provide the necessary and desired slidable movement of the guide member 52′ in the holder 36″.

It is to be understood that the forms of my invention herein shown and described are to be taken as preferred examples of the same and that various other changes in the shape, size and arrangement of parts may be resorted to without departing from the spirit of my invention, or the scope of the subjoined claims.

Having thus described my invention, I claim:

1. For use with a subcombination of a bow of the type having a bowstring and tensioning means connected to the bowstring, a projectile shooting guide comprising (a) support means for use on a bow, (b) an elongated guide member slidably supported by said support means and having a forward portion and a rearward portion, (c) a longitudinal projectile guide path in said guide member, (d) said guide member when supported on a bow by said support means extending toward a bowstring on a bow and positioned longitudinally in a direction of shooting motion of a bowstring, (e) said guide member being slidable rearwardly with a drawing movement of a bowstring, (f) said rearward portion of said guide member including a closed end for said guide path, (g) and means in said closed end of said guide member allowing a portion of a projectile to extend rearwardly past said closed end and to be movable rearwardly with said guide member in a drawing movement of a bowstring.

2. The projectile shooting guide of claim 1 wherein said guide member includes drag means for controlling slidable freedom of said guide member.

3. The projectile shooting guide of claim 1 wherein said guide member is adjustably secured to said support means for adjusting alignment of said guide member relative to said support means.

4. The projectile shooting guide of claim 1 wherein said guide member includes a grip means on said rearward portion for assisting rearward drawing movements of said guide member.

5. For use with a bow of the type having a bowstring and tensioning means connected to the bowstring, a subcombination of a projectile shooting guide comprising (a) support means for use on a bow, (b) an elongated guide member for support on a bow by said support means and having a forward portion and a rearward portion, (c) said guide member when supported on a bow by said support means extending toward a bowstring on a bow and positioned longitudinally in a direction of shooting motion of a bowstring, (d) guide means in said guide member for guiding a projectile to be shot by a bowstring, (e) and means in said guide member for allowing direct engagement of a projectile with a bowstring to one side of said guide member.

6. For use with a bow of the type having a bowstring and tensioning means connected to the bowstring, a subcombination of a projectile shooting guide comprising (a) support means for use on a bow, (b) an elongated guide member for support on a bow by said support means and having a forward portion and a rearward portion, (c) said guide member when supported on a bow by said support means extending toward a bowstring on a bow and positioned longitudinally in a direction of shooting motion of a bowstring, (d) said guide member having a front to back orientation, (e) and pivot means for permitting said support means and said guide member to move to a position substantially parallel with the longitudinal axis of a bow to reduce said front to back orientation of said guide member for ease of handling and storage.

7. For use with a bow of the type having a bowstring and tensioning means connected to a bowstring, a combination comprising (a) a projectile; and (b) a projectile shooting guide comprising support means for use on a bow, (c) an elongated guide member for support on a bow by said support means and having a forward portion and a rearward portion, (d) said guide member when supported on a bow by said support means extending toward a bowstring on a bow and positioned longitudinally in a direction of shooting motion of a bowstring, (e) and guide means in said guide member guiding said projectile to be shot by a bowstring, (f) said guide means including an elongated slot in said guide member extending longitudinally and in parallel alignment with a direction of shooting motion of a bowstring, (g) said slot extending from said rearward portion to said forward portion of said guide member;

(h) said projectile including a body portion and a wing portion, (i) said wing portion extending through said slot for operative engagement with a bowstring during 8. The combination of claim 7 wherein said wing portion includes a nocking means for engaging a bowstring.

9. The combination of claim 7 wherein said wing portion extends rearwardly beyond said rearward portion of said guide member so that a user can grip said wing portion and said bowstring behind said rearward portion of said guide member.

10. For use with a bow of the type having a bowstring and tensioning means connected to the bowstring, a combination comprising (a) a projectile; and (b) a projectile shooting guide comprising support means for use on a bow, (c) an elongated guide member for support on a bow by said support means and having a forward portion and a rearward portion, (d) said guide member when supported on a bow by said support means extending toward a bowstring on a bow and positioned longitudinally in a direction of shooting motion of a bowstring for guiding said projectile to be shot by a bowstring;

(e) said projectile including multiple nocking means for each respectively receiving a bowstring.

11. For use with a bow of the type having a bowstring and tensioning means connected to a bowstring, a combination comprising (a) a projectile; and (b) a projectile shooting guide comprising support means for use on a bow, (c) an elongated guide member for support on a bow by said support means and having a forward portion and a rearward portion, (d) said guide member when supported on a bow by said support means extending toward a bowstring on a bow and positioned longitudinally in a direction of shooting motion of a bowstring for guiding said projectile to be shot by a bowstring;

(e) said projectile when in a loaded position in said guide member including a rearwardly facing portion with a lateral center, (f) nocking means on said projectile for operatively engaging a bowstring with said projectile, (g) said nocking means being positioned laterally off to one side of said lateral center of said projectile.

* * * * *